United States Patent [19]

Jacober

[11] Patent Number: 4,792,073

[45] Date of Patent: Dec. 20, 1988

[54] SKI CARRIER

[76] Inventor: Jeffrey M. Jacober, 2 Round Hill Ct., East Greenwich, R.I. 02818

[21] Appl. No.: 183,396

[22] Filed: Apr. 13, 1988

Related U.S. Application Data

[63] Continuation of Ser. No. 025,027, Mar. 12, 1987, abandoned.

[51] Int. Cl.[4] ..... A45C 71/00; B65D 69/00; A63C 11/02

[52] U.S. Cl. ..... 224/202; 224/251; 224/257; 224/907; 224/917; 294/147; 150/52 R; 280/814; 70/58

[58] Field of Search ..... 224/150, 907, 913, 917, 224/202, 204, 205, 208, 250, 251, 255, 257, 258, 264; 280/814, 815; 150/52 R, 52 G; 294/141-149, 150, 151, 152; 70/57, 58, 63, 64, 69, 76

[56] References Cited

U.S. PATENT DOCUMENTS

| | | | |
|---|---|---|---|
| 2,118,875 | 5/1938 | Windheim | 224/205 |
| 2,250,388 | 7/1941 | Mickelberg | 280/815 |
| 2,522,381 | 9/1950 | Kamer | 150/52 R |
| 2,618,880 | 11/1952 | Sourek | 150/52 R X |
| 3,257,054 | 6/1966 | Miesel | 294/149 |
| 3,380,504 | 4/1968 | Green | 150/52 R |
| 3,737,171 | 6/1973 | Becker | 280/814 |
| 3,909,031 | 9/1975 | Schmaedeke et al. | 280/814 |
| 3,917,137 | 11/1975 | Wilkins | 224/917 X |
| 3,935,977 | 2/1976 | Bonnett | 294/147 |
| 3,960,302 | 6/1976 | Mazzoni, Jr. | 224/917 X |
| 3,964,653 | 6/1976 | Strutz | 224/257 X |
| 3,990,655 | 11/1976 | Covell | 294/147 |
| 4,055,287 | 10/1977 | Champenois, Jr. | 294/141 |
| 4,120,437 | 10/1978 | Hara | 280/814 |
| 4,197,890 | 4/1980 | Simko | 150/52 R X |
| 4,294,387 | 10/1981 | Wnek | 224/917 X |
| 4,326,747 | 4/1982 | Finnegan | 294/147 |
| 4,377,306 | 3/1983 | Abatecola | 294/147 |
| 4,401,246 | 8/1983 | Dickinson et al. | 224/150 |
| 4,463,885 | 8/1984 | Ball et al. | 224/250 |
| 4,518,107 | 5/1985 | Amos | 224/215 |
| 4,550,869 | 11/1985 | Johnson | 224/202 |
| 4,553,779 | 11/1985 | Shortridge | 294/147 |
| 4,674,787 | 6/1987 | De Vera | 294/147 |
| 4,746,159 | 5/1988 | Webb et al. | 294/147 |

FOREIGN PATENT DOCUMENTS

| | | | |
|---|---|---|---|
| 120642 | 1/1931 | Austria | 280/814 |
| 167940 | 4/1951 | Austria | 224/917 |
| 1332131 | 6/1963 | France | 280/814 |
| 2278289 | 3/1976 | France | 224/917 |
| 2556605 | 6/1985 | France | 224/917 |
| 331720 | 9/1958 | Switzerland | 224/917 |
| 655447 | 4/1986 | Switzerland | 280/814 |

*Primary Examiner*—Henry J. Recla
*Assistant Examiner*—Ernest G. Cusick
*Attorney, Agent, or Firm*—Lockwood, Alex, Fitzgibbon & Cummings

[57] ABSTRACT

A ski carrier is provided for use with skis to protect bindings, facilitate portability and prevent theft. The carrier is of tubular configuration with opposite ends defining restricatable openings through which ski boards are received, the carrier covering the bindings. A realeasable fastening assemby is provided on the carrier to facilitate its application and removal to and from skis, and both the fastening assembly and carrier body include lock receiving rings on the like to permit locking of the fastening assembly in the carrier closing position and locking of the carrier with skis included to a fixed base. The ski carrier includes padding for protection of the bindings as well as protection of the person carring the skis. The carrier is provided with a shoulder strap to facilitate portability.

13 Claims, 2 Drawing Sheets

SKI CARRIER

This application is a continuation of application Ser. No. 025,027, filed Mar. 12, 1987, abandoned.

BACKGROUND OF THE INVENTION

The skier must transport skis either by hand or vehicle or both. Because of the configuration of skis, such transport is frequently cumbersome particularly when skis are carried by the user. Not only are the ski boards lengthy and thereby unwieldy, the edges of the boards are rather sharp and can cause discomfort during physical transporting thereof. Additionally, physical transportion of skis by the user frequently occurs between actual periods of skiing resulting in the skis being snow-covered or wet. Still further, even dry skis can create a problem with clothing in the event the wax used on the skis is transferred to the clothing during transporting of the skis.

The bindings of skis add to the problems of ease of transportation not only because they present projections and sharp edges, but also because their triggering mechanisms must be protected from inadvertent misadjustment conceivably resulting ultimately in a personal safety problem to the user. In order to retain the requisite degree of efficient performance, the bindings should also be protected from contact with road debris when being transported in a conventional rack on a vehicle. Road salt residue if permitted to build up in the binding mechanisms can adversely affect their operation thus presenting another potential threat to the safety of the user.

Various types of ski board and ski binding protective devices in the form of covers or the like have been proposed. Those that fully enclose the ski boards and bindings are often cumbersome to install and remove, are not adapted to ski boards of varying length and are often expensive. Covers for ski bindings alone have also been proposed, but such covers to date have failed to provide the most desirable multiple functions of not only protecting bindings but also facilitating portability and preventing theft.

The present invention, in the form of a ski binder cover, supplies the aforesaid multiple functions in an uncomplicated, cost effective manner. The subject ski carrier utilizes a preferably flexible tubular body adapted to receive the ski bindings therein with the ski boards projecting from opposite open ends of the carrier. One such end of the carrier is of fixed opening size so that only the ski boards may be received therethrough. The size of the opposite end opening is adjustable to facilitate application and removal of the carrier to and from the skis. Ease of application and removal is further enhanced by the provision of a releasable fastener forming a part of the tubular body of the carrier. The fastener as well as other elements of the carrier body provide retention means for a locking mechanism whereby the carrier, including the skis partially covered thereby, may be locked to a fixed base to negate theft thereof. The carrier includes other important features such as a shoulder strap and, preferably, padding which cooperate to facilitate portability. The padding protects the bindings and simultaneously protects the user from the discomfort of sharp edges and projections. Other advantages will become apparent from the following description of a preferred embodiment of the invention.

SUMMARY OF THE INVENTION

A ski carrier for use with skis to protect bindings, facilitate portability and prevent theft includes a body of tube-like configuration with oppositely positioned end openings, one of the openings being adjustable in size. Anti-theft locking means are provided in conjunction with the variably sized opening as well as a releasable fastener which facilitates application and removal of the carrier. Preferably, the carrier is padded to protect the ski bindings as well as to protect the user from the ski bindings during personal transporting of the skis in the carrier.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
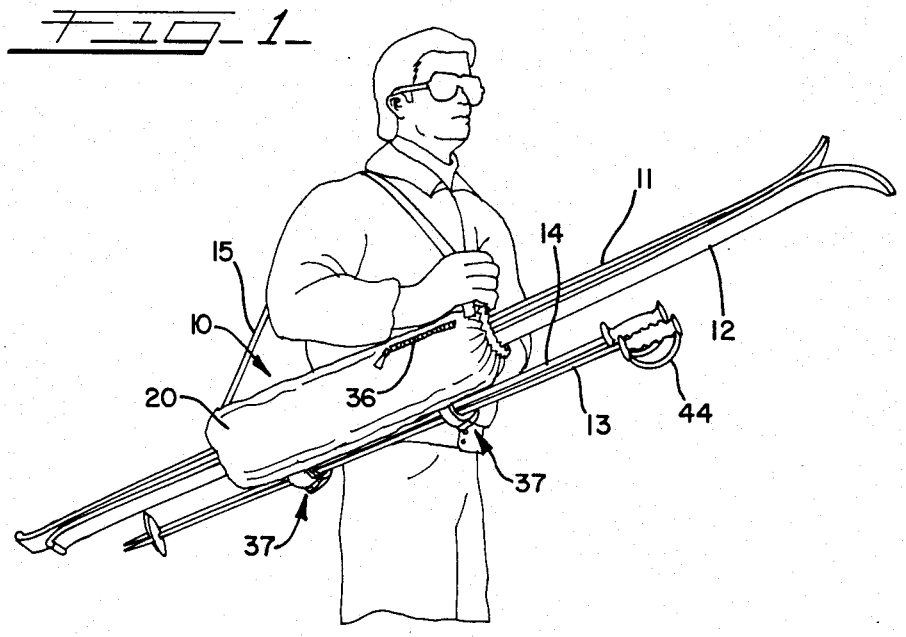
FIG. 1 is a graphic illustration of a skier utilizing the ski carrier of the present invention during personal transporting of skis.

FIG. 1 illustrates the ski carrier, generally designated as 10, in its operative position enclosing the bindings of a conventional pair of skis, the ski boards 11 and 12 being illustrated as projecting outwardly from opposite ends of carrier 10. Conventional ski poles 13 and 14 are suitably attached to the bottom surface portion of carrier 10 by attachment means to be described. The upper surface portion of carrier 10 as viewed in FIG. 1 adjacent opposite ends thereof has suitably attached thereto carrier means in the form of a shoulder strap 15 which is slung over the shoulder of the user as pictorially represented in FIG. 1.

Figure 2:
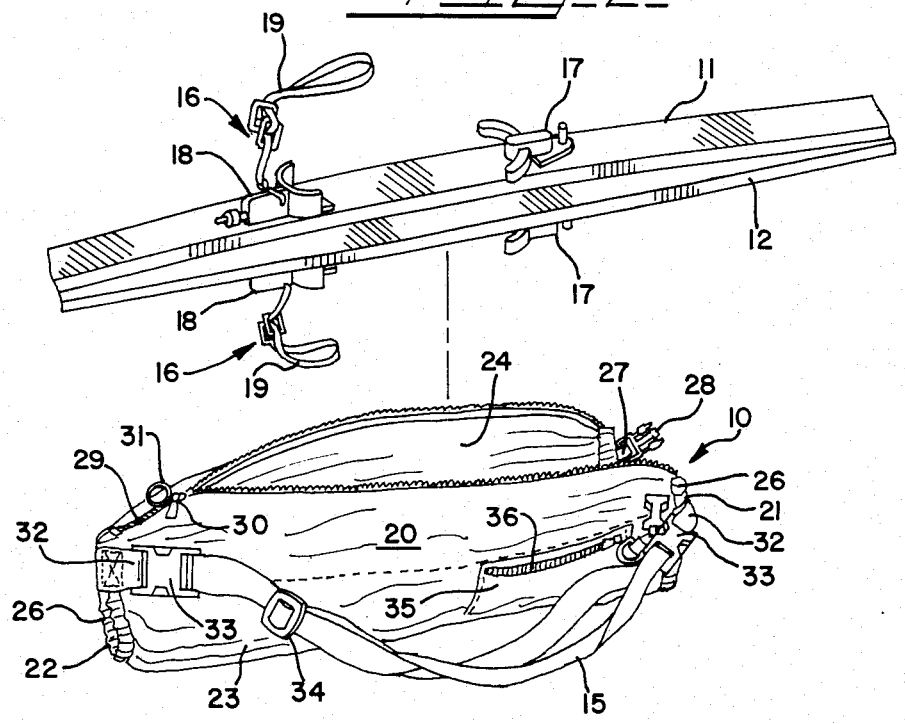
FIG. 2 is a fragmentary perspective view of a pair of skis and the ski carrier of the present invention in condition to be combined thereby illustrating the manner in which the carrier is applied to skis.
Figure 3:
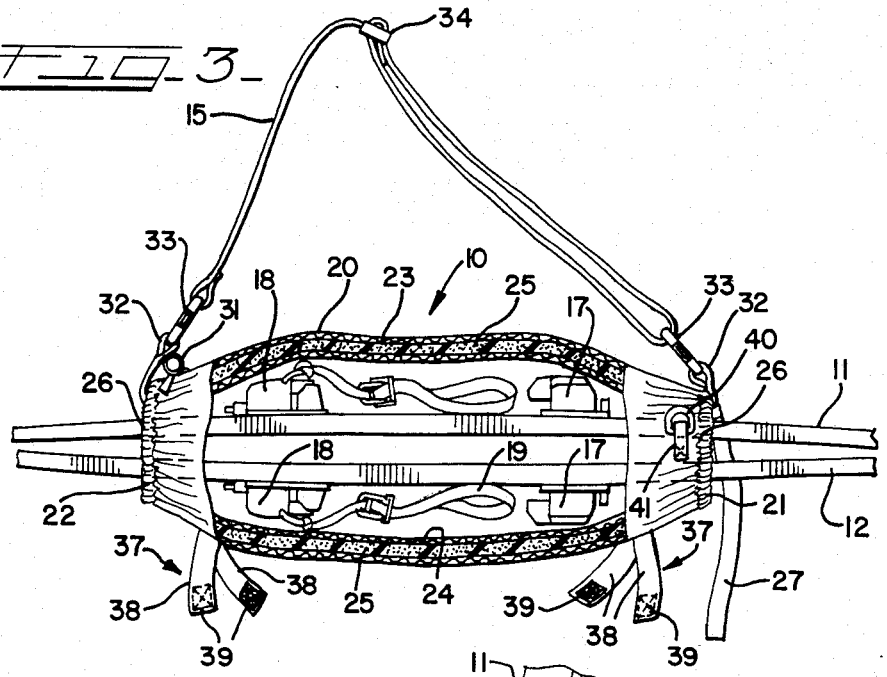
FIG. 3 is a fragmentary sectional view in elevation of the carrier applied to a pair of skis.

Referring particularly to FIGS. 2 and 3, ski carrier 10 and the manner in which it is utilized to cover the bindings of skis 11 and 12 are illustrated in detail. Each ski 11 and 12 is provided with a conventional binding assembly generally designated by the numeral 16. Each binding assembly 16 includes a toe assembly 17, a heel assembly 18 and an ankle strap 19. As is well known, heel assembly 18 is adjustable and appropriate adjustment of each binder assembly 16 establishes the pressure conditions under which the skier's foot is released from the toe and heel portion of the binder to establish the requisite margin of safety.

As described hereinabove, in order to maintain proper and dependable operation of a ski binding, it is necessary to protect same from inadvertent misadjustment as well as introduction of foreign material, such as road salt, that can interfere with the necessary instantaneous response for which the binding is designed. Thus, it is of particular importance to protect ski bindings while it is of lesser importance to protect the ski boards. The ski carrier 10 of the present invention attains these goals in an efficient and economical manner while providing additional advantages.

Carrier 10, as illustrated, is basically in the form of a cylindrical or tubular body 20 provided with oppositely positioned open but gathered ends identified for convenience as an upper end 21 and a lower end 22. The tube-like body 20 is preferably formed from flexible water and dirt repellant fabric or material such as lightweight, yet strong nylon. Fabric composed of combination material can also be suitable. As best illustrated in FIG. 3, carrier 10 includes an outer nylon cover 23 and an inner nylon cover 24 between which is quilted a layer of padding 25. The padding layer may be formed from any suitable foam-like material.

Both upper end 21 and lower end 22 are preferably defined by a ring-like portion 26 of gathered material. Adjacent edges of outer and inner covers 23 and 24 are appropriately stitched together in a known manner to define loops of gathered material 26 at each end of carrier body 20. The diameter or circumference of each end opening 21 and 22 is substantially less than the largest diameter or circumference of carrier body 20 when opening 21 is gathered. Received within the looped and gathered portion 26 of bottom end opening 22 is a continuous cord or ribbon of suitable flexible material (not shown) to fix the maximum diameter or circumference of the bottom end opening. The size of the bottom opening is such that the boards of skis 11 and 12 may be readily received therethrough but one or more binding 16 cannot be received therethrough. Accordingly, when the carrier 10 is applied to a pair of skis in a manner to be described, the bottom opening 22 cannot move past the bindings 16.

Upper end opening 21 is adjustable in size by reason of a slidable strap 27 being slidably received through gathering 26 of opening 21. One end of the sliding strap 27 has a buckle 28 (best shown in FIGS. 2 and 4) attached thereto. Buckle 28 is of conventional design being adapted to receive in the free end thereof the other end of strap 27 and releasably grip the same to permit foreshortening or lengthening of the strap 27 within gathered portion 26 of upper opening 21. Gathered portion 26 of upper opening 21 is of greater longitudinal length, or total expanded circumference, than gathered portion 26 of lower opening 22. Thus, upper opening 21 may expand or contract depending upon loosening or tightening of the belt 27 through the buckle 28 thereby providing the upper opening with a variable circumference.

As best shown in FIG. 2, upper opening 21 is split by the provision of a releasable fastening means in the form of a zipper assembly 29 or the like extending from a point just short of gathering 26 of lower end 22, throughout the remaining longitudinal extent of carrier body 20 and terminating at the upper end opening 21. FIG. 2 illustrates carrier body 20 in unzipped or fully opened condition, and it will be noted that gathered area 26 of upper end 21 is separated at the zipper line. The zipper assembly slider 30 includes a metal ring 31 which not only may be used to assist in operation of the slider, but also forms a part of the anti-theft lock receiving means of ski carrier 10.

The arrangement just described permits the opening of carrier 10 by retraction of zipper slide 30 as well as separation of the free end of strap 27 from buckle 28. This open condition is shown in FIG. 2, and it will be noted that the gathering 26 of upper end 21 is separated when the zipper assembly 29 is separated and is closed when zipper assembly 29 is closed. The carrier is mounted on a pair of skis by placing the skis in bottom-to-bottom engaging relation as shown in FIGS. 1 and 2, threading the rear ends of the engaging ski boards through bottom opening 22 of carrier 10, placing the open side walls of the carrier around the outwardly projecting binding assemblies 16 so as to completely encompass the same, placing the separated gathering 26 of top open end 21 around the ski boards forwardly or upwardly of the binding assembly 16, operating zipper slide 30 to close carrier body 20 and reattaching the free end of strap 27 with buckle 28 to close the gathered portion 26 of upper open end 21 around the ski boards forwardly of binding assemblies 16.

In this manner, the binding assemblies are completely covered and protected from foreign material as well as being basically protected from inadvertent misadjustment by reason of the relatively thick padding 25 utilized in constructing body 20 of carrier 10. With bottom opening 22 being held against expansion, the carrier cannot move upwardly along the skis to thereby expose the binding assemblies 16. Appropriate tightening of belt 27 through buckle 28 circumferentially restricts upper open end 21 thereby preventing downward movement of the carrier along the skis to thus expose the binding assemblies in that direction. The carrier is simply and effectively held captive on the skis by the binding assemblies. It will be appreciated that this principal of binding assembly protection is equally useful in application to just a single ski as well as a pair of skis.

Shoulder strap 15 may be of any conventional design, and as illustrated in FIG. 3, preferably includes a pair of opposite end anchoring loops 32 suitably attached to carrier body 20 and carrying one end of a two-piece detachable buckle assembly 33, the other end of each buckle assembly 33 being attached to a loop in the adjacent end of shoulder strap 15. Adjustment slide 34 is provided to vary the length of strap 15 in the conventional manner. The length of carrier body 20 is such that by anchoring the shoulder strap adjacent opposite ends of the carrier body a comfortable balance of skis of varying length is obtained. In this respect it will be appreciated that the ski carrier of the present invention is adapted to be used with skis having boards of variable length considering that the carrier is designed to merely cover the binding assemblies which normally are of fixed dimensions. It should also be noted that shoulder strap 15 may be disconnected from carrier body 20 at its buckles 33 when the entire assembly is to be transported by vehicle.

Shoulder support of skis being carried by the user is quite efficient. In utilizing shoulder support, the skis are raised sufficiently from the ground and are tilted sufficiently relative to the ground that varying lengths of skis may be easily handled without engaging the ground during transportation. The provision of padding 25 quilted between outer and inner liners 23 and 24 not only protects the binding assemblies 16 as previously mentioned, but also protects the person carrying the skis. Binding assemblies and skis include sharp edges and numerous projections which can cause discomfort when skis are carried from the shoulder as illustrated in FIG. 1. The provision of padding 25 eliminates this source of discomfort as projections will not be uncomfortably felt by the person transporting the skis. It will be understood that padding 25 may be provided in the form of a separate, removable inner lining.

Substantially longitudinally aligned with shoulder strap 15 is a storage pocket 35 releasably closed by a zipper assembly 36 (FIGS. 1 and 2). This poclet is formed in the outer surface of carrier body 20 that is readily accessable to the hand of the user (see FIG. 1). Additionally, the location of storage pocket 35 away from that portion of carrier body 20 which contacts the transporter avoids any possibility of discomfort caused from articles carried in the storage pocket.

On the under side of carrier body 20 in relation to the carrying position of said body as illustrated in FIG. 1, a pair of ski pole attachment members 37 are provided. Each member 37 includes a pair of flexible straps 38 provided at the ends thereof with a known type of quick attachment and release material 39. These straps are best shown in FIG. 3, and it will be noted that the strap assemblies are longitudinally spaced along the bottom surface of carrier body 20 so as to receive and hold ski poles 13 and 14 in balanced relationship as shown in FIG. 1. The ski poles are inserted between straps 38, and the ends of straps 39 are placed in mutual engagement to releasably retain the poles for transportation with carrier body 20.

Figure 4:
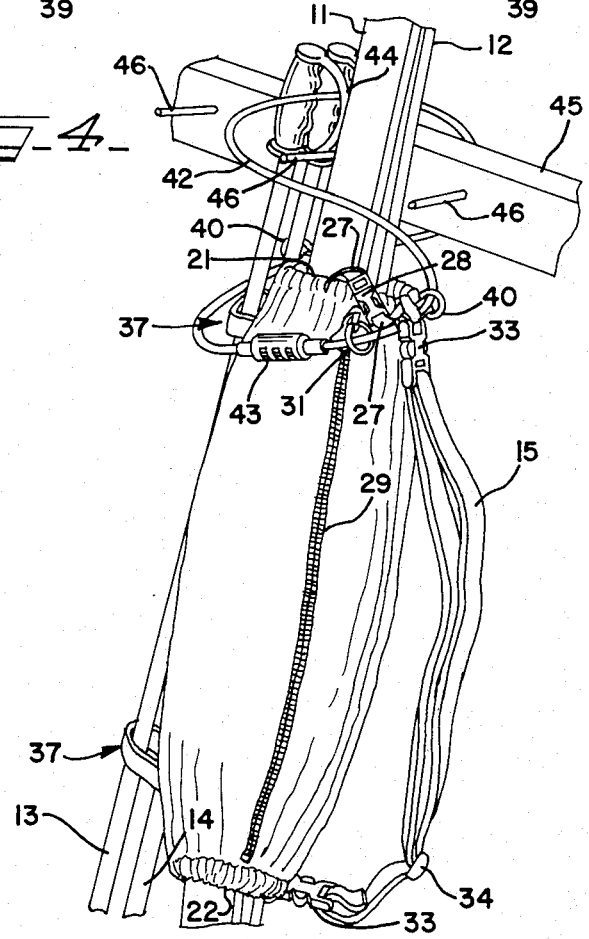
FIG. 4 is a fragmentary perspective view of the carrier applied to a pair of skis and the locking arrangement of the present invention applied to the carrier, skis and an illustrative fixed base.

The ski carrier of the present invention includes anti-theft means capable of receiving a known type of cable and lock arrangement as illustrated in FIG. 4. As previously described, zipper slide 30 is provided with metal ring 31. When the zipper assembly is closed, metal ring 31 is adjacent upper open end 21 of the carrier. Also adjacent this end, one or more lock cable receiving rings 40 are carried by body 20 of carrier 10. FIG. 3 illustrates one manner in which rings 40 may be mounted on carrier 10. The ring illustrated is received in a closed loop of belt material 41 which is appropriately sewed to or otherwise fastened to carrier body 20. Any number of such rings 40 may be supplied in peripherally spaced relationship.

FIG. 4 illustrates a conventional locking cable 42 extending through rings 31 and 40 into releasable locking engagement with a cylindrical combination lock 43. The cable extends through the handle guards 44 of ski poles 13 and 14 and around a suitable fixed base 45. Base 45 is of a conventional type found at ski facilities, typically involving the utilization of a horizontally extending board which is elevated from the ground and includes a plurality of spaced, outwardly projecting pins 46 between which skis may be placed in resting relation with fixed board 45 while being held upright by spaced pins 46.

In the locked condition of the ski carrier and skiing components, zipper assembly 29 of carrier body 20 cannot be operated, at least to an extent that would permit passage of the skis and bindings through opening 21. Without such operation of this zipper assembly, skis 11 and 12 cannot be removed from ski carrier 10. Because of the threading of the locking cable through a series of rings 31 and 40 forming a part of ski carrier body 20, and by threading the cable about a fixed base, the carrier and skis cannot be separated from the base. Additionally, the proximity of the handles of ski poles 13 and 14 to locking cable 42 permits threading of the locking cable through such handles to lock the ski poles to base 45, as illustrated. This anti-theft locking arrangement is readily accomplished in a simple manner without any adjustment or rearrangement of any of the components of the total assembly. The locking components may be stored in pocket 35 when not in use.

While a particular embodiment of the invention has been shown and described, it will be obvious to those skilled in the art that changes and modifications may be made therein without departing from the invention in its broader aspects; and, therefore, the aim in the appended claims is to cover all such changes and modifications as fall within the true spirit and scope of the invention.

I claim:

1. A ski carrier in the form of a ski binder cover constructed of flexible material, comprising:

a tubular body member of flexible material, said body having a preselected circumference of a size adapted to be received around bindings of a pair of skis to protectively cover same, said flexible material body member having a ski binding covering area and having oppositely positioned open ends adapted to receive a pair of skis therethrough;

one of said open ends is fixedly restricted in circumference so as to be adapted to permit the passing of a pair of ski boards therethrough but prevent the passing of ski bindings affixed to such ski boards therethrough;

the other of said open ends being of a circumference that is openable and closeable between an open orientation and a closed orientation that provides a substantially fixedly restricted circumference, said open orientation being adapted to selectively permit the passing of ski bindings affixed to such ski boards therethrough while said closed orientation selectively prevents passing of ski bindings through said openable and closeable circumference;

carrier means affixed to and extending from said tubular body member of flexible material at locations that are respectively generally proximate to said oppositely positioned open ends of said tubular body member;

said tubular body member of flexible material includes anti-theft locking cable-receiving means for locking said tubular body member of flexible material to a fixed base and for preventing removal of skis from said ski carrier by simultaneously locking said other open end in its said substantially fixedly restricted closed orientation;

said tubular body member of flexible material further includes releasable fastener means for permitting longitudinal opening of said tubular body member of flexible material in a longitudinal direction so that the ski carrier is adapted to receive a portion of a ski that includes ski binding members; and said anti-theft locking cable-receiving means includes a locking cable-engaging member on said releasable fastener means and a locking cable-receiving member on said tubular body member of flexible material, said locking cable-receiving member being secured to said tubular body member of flexible material at a location generally at said other open end and generally adjacent to the location of said locking cable-engaging member when said releasable fastener means is in a fully closed orientation.

2. The ski carrier of claim 1, wherein the carrier means is in the form of a shoulder strap attached to said body member.

3. The ski carrier of claim 2, wherein said body member includes a storage pocket substantially longitudinally aligned with said shoulder strap.

4. The ski carrier of claim 3, wherein said body member includes padding in the ski binding covering area thereof.

5. The ski carrier of claim 4, wherein said body member further includes attachment means located on the exterior of said body member for attaching a ski pole to the body member.

6. The ski carrier of claim 1, wherein said body member includes padding in said ski binding covering area thereof.

7. The ski carrier of claim 6, wherein the carrier means is in the form of a shoulder strap attached to said body.

8. The ski carrier of claim 1, wherein said body member has an exterior surface and further includes attachment means located on said exterior surface of said body member, said attachment means being for attaching a ski pole to the body member.

9. The ski carrier of claim 1, wherein said anti-theft locking cable-receiving means includes a series of members including a further locking cable-receiving member secured to said tubular body member of flexible material, said further locking cable-receiving member being at a location that is generally at said other open end of the tubular body member of flexible material and that is on a side of said releasable fastener means which is opposite to that of said locking cable-receiving member.

10. A flexible ski carrier adapted for use with skis to protect bindings thereof, to facilitate portability and to prevent theft, said carrier comprising:

a carrier body member of flexible material and of tube-like configuration;

a first open end in said body member of flexible material;

a second open end in said body member of flexible material that is opposite said first open end;

opening and closing means for defining said first open end to permit opening and closing of the substantially fixedly restricted opening defined thereby, said second open end defining an opening of limited size;

releasable fastening means longitudinally oriented on said body member to permit at least partial longitudinal opening and closing of the body member of flexible material between an open position location and a closed position location, said releasable fastening means being adapted to facilitate placing said body member of flexible material about the binding of a ski;

locking cable-receiving means for permitting locking of said releasable fastening means at said closed position location, said locking cable-receiving means including a member of said releasable fastening means and a locking cable-receiving member located on said body member of flexible material adjacent to said closed position location of the releasable fastening means, said locking cable-receiving means being for receiving a lockable cable means therethrough, said cable means being adapted for locking said carier and any ski received therein to a fixed base; and carrier means forming a part of said tube-like body member of flexible material to facilitate portability thereof.

11. The ski carrier of claim 10, wherein said carrier body member is formed from flexible material and padding means are provided at least in the area thereof adapted to surround ski bindings.

12. The ski carrier of claim 10, wherein said members of the locking cable-receiving means are in the form of rings suitably attached to said releasable fastening means and said carrier body member of flexible material.

13. The ski carrier of claim 10, wherein said locking cable-receiving means includes a series of members that include a further locking cable-receiving member secured to said carrier body member of flexible material, said further locking cable-receiving member being at a location that is generally at said first open end of the body member of flexible material and that is on a side of said releasable fastening means which is opposite to that of said locking cable-receiving member.

* * * * *